United States Patent [19]

Poumey et al.

[11] Patent Number: 4,996,405

[45] Date of Patent: Feb. 26, 1991

[54] INDUCTIVE HEATED PORTABLE HOT PLATE

[75] Inventors: Michel Poumey, Ecully; Jacques Charvet, Voiron, both of France

[73] Assignees: Cableco; Establissements Jean Charvet, both of France

[21] Appl. No.: 510,048

[22] Filed: Apr. 17, 1990

[30] Foreign Application Priority Data

Apr. 18, 1989 [FR] France ..... 89 05378

[51] Int. Cl.[5] ..... H05B 6/12

[52] U.S. Cl. ..... 219/10.493; 219/10.67; 219/10.75; 219/10.77

[58] Field of Search ..... 219/10.493, 10.67, 10.75, 219/10.79, 10.77

[56] References Cited

U.S. PATENT DOCUMENTS

| | | | |
|---|---|---|---|
| 3,530,499 | 9/1970 | Schroeder | 219/10.493 |
| 3,742,179 | 6/1973 | Harnden, Jr. | 219/10.493 |
| 3,761,668 | 9/1973 | Harnden, Jr. et al. | 219/10.493 |
| 3,979,572 | 9/1976 | Ito et al. | 219/10.493 |
| 4,038,518 | 7/1977 | Morton et al. | 219/10.493 |
| 4,667,074 | 5/1987 | Kubo et al. | 219/10.493 |
| 4,910,372 | 3/1990 | Vukich | 219/10.493 |

FOREIGN PATENT DOCUMENTS

| | | |
|---|---|---|
| 0056974 | 8/1982 | European Pat. Off. . |
| 2505341 | 8/1976 | Fed. Rep. of Germany . |
| 2231177 | 12/1974 | France . |
| 2582896 | 12/1986 | France . |
| 2588711 | 4/1987 | France . |
| 2166916 | 5/1986 | United Kingdom . |

*Primary Examiner*—Philip H. Leung

*Attorney, Agent, or Firm*—Wall and Roehrig

[57] ABSTRACT

A portable electric hotplate is heated by an inductive heating power source having a glass ceramic plate and a primary induction coil. The hotplate has an outer heat conductive casing, the top of which forms a hotplate and the base of which is made from a dielectric material. The top surface of the hotplate is heated by an electrical resistor embedded therein adjacent the top surface, which resistor is connector to a secondary inductive circuit mounted adjacent the dielectric base of the hotplate. The hotplate secondary circuit has an induction coil which serves as the secondary for the electromagnetic field emitted by the primary induction coil in the heating power source. The secondary coil is connected in parallel with a capacitor and the two are connected in series to the electrical resistor embedded in the top surface of the hotplate. The values for the inductance (L) of the secondary-induction coil and for the capacitance (C) of the capacitor in the hotpate are selected such that the oscillating circuit formed by the defined secondary circuit has a resonant frequency slightly higher than the resonant frequency of the primary induction circuit of the inductive heating power source so as to eliminate reflection of capacitive impedance to the primary circuit that would reduce the maximum inductive power available in the secondary circuit.

8 Claims, 2 Drawing Sheets

INDUCTIVE HEATED PORTABLE HOT PLATE

The present invention relates to a removable electric hotplate, intended to be used on an inductive heating-power source. It relates in particular to the power supply of such plates from any inductive heating-power source.

The use of energy from an inductive heating-power source has been known for some time. Hitherto, however, it was limited to the occasional operation of a few appliances, in particular domestic electrical appliances. Moreover, these appliances did not require any regulation, and in particular any heat regulation. Being able to make use of the maximum nominal power of the induction generator was consequently of little importance.

The present invention aims, within the scope of a removable and independent hotplate which can be washed by soaking, to use virtually all the nominal power of an inductive heating-power source generator.

Inductive heating-power sources traditionally consist mainly of a generator, connected to the mains and delivering an alternating electric current with a frequency which can vary and is in particular between 25 and 35 kHz. This alternating current traverses an inductor formed by a self-induction coil which then emits an electromagnetic field. The latter is picked up by means of a transducer formed by a self-induction coil which subsequently generates an induced electromotive force in a secondary electric circuit. This alternating electric current, with the same frequency as that of the primary circuit, is then used for the operation of the hotplate.

The use of induced electric current thus enables the presence of leads and other electric wires for supplying power to the appliances, in particular the hotplate, to be done away with, therefore eliminating the various disadvantages associated with the use of such electric leads, but also enables the presence of additional electrical equipment such as wall sockets to be done away with, considerably increasing safety, in particular when frequent washing is required.

This removable electric hotplate, intended to be used on an inductive heating-power source, comprises a heat-conducting outer metal casing and a base made from an electrically insulating material, the said casing being heated by means of an electric resistor supplied by an electric circuit.

In this unit, the electric circuit for supplying the resistor or resistors consists of a self-induction coil which serves as a transducer of the electromagnetic field emitted by the inductor of the inductive heating-power source and is mounted in parallel with a capacitor, said circuit being closed on said electric resistor, the values for the inductance L of the self-induction coil and for the capacitance C of the capacitor being selected such that the oscillating circuit thus defined begins to resonate at a frequency slightly higher than that of the induction circuit of the inductive heating-power source.

In other words, the present invention consists in connecting a capacitor intended to form an oscillating circuit termed a "trap circuit" in parallel to the secondary circuit supplying the electric resistor heating the hotplate so as to obtain resonance and thus to obtain the maximum nominal power of the induction generator.

Advantageously, in practice:

the secondary electric circuit is closed by a switch actuated by a thermostat, the thermometric probe of which is fastened to the inner surface of the hotplate;

the thermometric probe forms an integral part of the hotplate;

the self-induction coil forming the transducer of the secondary circuit is at a distance of between 2 and 20 mm from the glass-ceramic plate of the inductive heating-power source; for it has been found that if this distance is less than 2 mm, the heat built up in the metal casing cannot dissipate, or dissipates very poorly, giving rise to malfunctions or even damage inside the circuit; on the other hand, if this distance is greater than 20 mm, a drastic fall in the absorbed energy absorbed by the self-induction coil forming the transducer is observed;

the heating unit consists of two parts, a hot part comprising the heating resistor, the thermometric probe, the hotplate proper and the transducer, and a cold part comprising mainly the capacitor and the thermostat proper, respectively, the two parts being interconnected by means of connections;

the heating resistor is thermally insulated on all its surfaces except that opposite the hotplate;

the resistor is thermally insulated by means of a mineral-based microporous thermal insulating material;

the unit furthermore comprises an indicator lamp, electrically supplied by an additional turn situated on the transducer of the secondary circuit and indicating that the resistor or resistors are live.

The manner in which the invention may be realized and the advantages which result from it will emerge more clearly from the embodiment given by way of a non-limiting guide and with reference to the attached figures in which.

Figure 1:
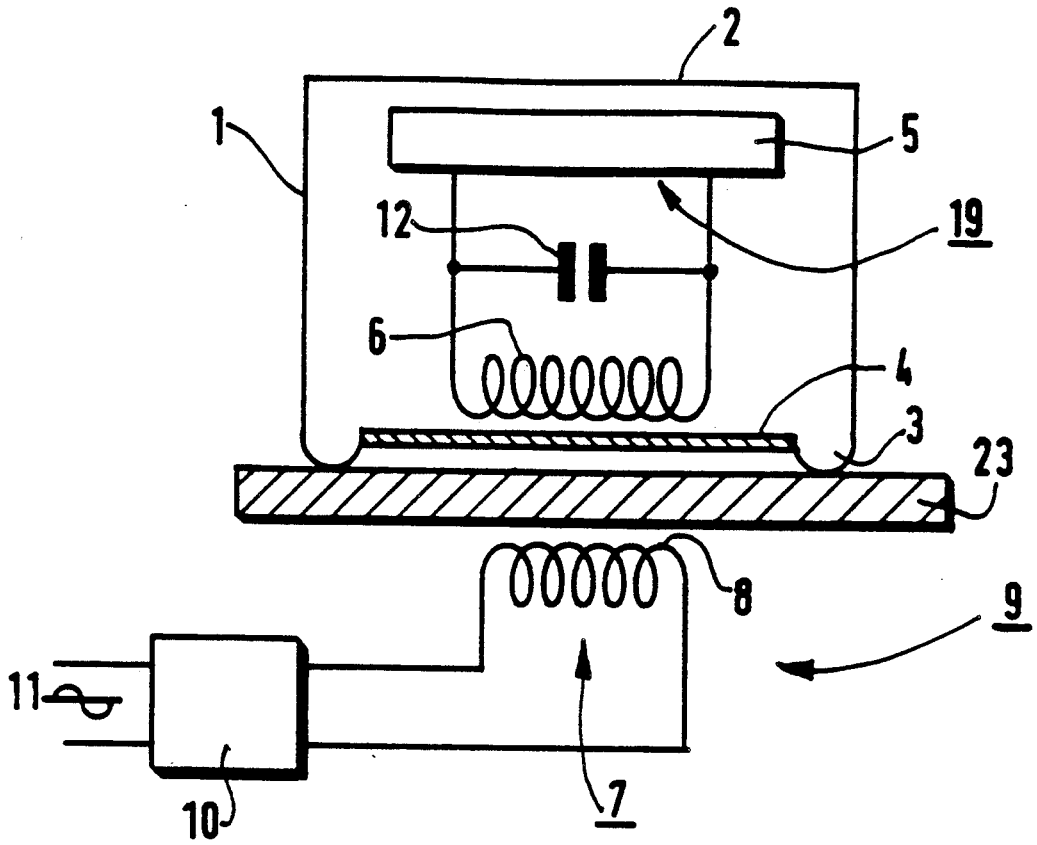
FIG. 1 is a simplified diagram of the operation of the hotplate according to the invention.
Figure 2:
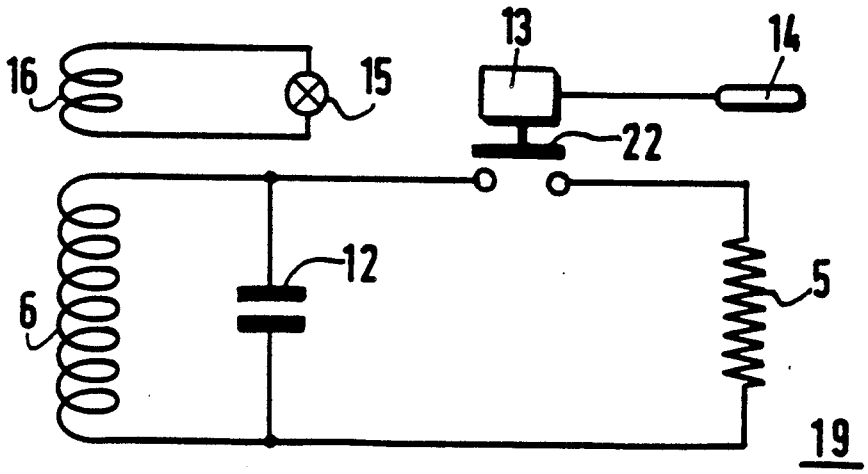
FIG. 2 is a schematic representation of the electric circuits according to the invention.
Figure 3:
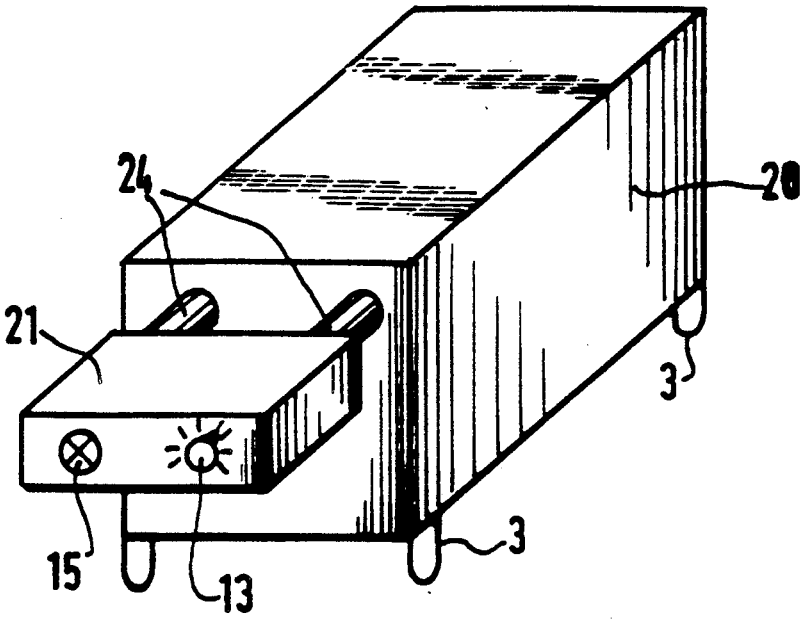
FIG. 3 is a schematic representation of an embodiment according to the invention.

The example which will be described hereinbelow corresponds to a removable electric hotplate. It goes without saying, however, that the scope of the present invention is in no way limited to the single embodiment described and is quite capable of extension to systems with multiple plates, it being possible for the dimensions and shapes of these plates to vary depending on the specific requirements of the users. They may, for example, be in the form of cooking surfaces.

According to the present invention, the hotplate basically consists of a metal casing with, for example, a parallelepipedal shape (1) and good thermal conductivity. This metal casing provides in particular a plane and horizontal hotplate proper (2). Depending on its applications, however, the plate (2) may be ribbed or even have honeycombed or other shapes. Similarly, it is not necessarily plane and may have a certain slope so as to enable in particular juice or grease to run off. This casing (1) stands on an inductive heating-power source having the general reference (9), via feet (3). The base (4) of the metal casing is made from an electrically insulating material, attached to said casing. It is advantageously plane and parallel with the inductor (8) described hereinbelow.

In a known manner, the inductive heating-power source (9) basically comprises a support plate (23) made from glass-ceramic material and an electric circuit termed the primary circuit having the general reference (7). This primary circuit essentially consists of an inductor (8) formed by a plane coil, parallel to the glass-ceramic plate and supplied by a generator (10) with alternating electric current with a frequency between 25 and 30 kHz. The generator (10) is itself charged by the mains at 220/230 volts and at a frequency of 50 or 60 Hertz. The unit formed by the metal casing (1) and the base (4) advantageously forms a leakproof box, thus enabling the plate to be washed by soaking without any danger of damaging the electric circuit inside.

The secondary electric circuit, situated inside the metal casing (1), mainly comprises an electric resistor (5) mounted in series with a transducer (6) formed by a coil made from conducting wires. This transducer (6) is itself mounted in parallel with a capacitor (12).

As already mentioned, the transducer (6) is intended to pick up the electromagnetic field generated by the inductor (8) of the primary circuit and to transform this electromagnetic field into induced electromotive force which consequently generates an electric current with the same frequency as the electric current traversing the inductor (8).

Figure 4:
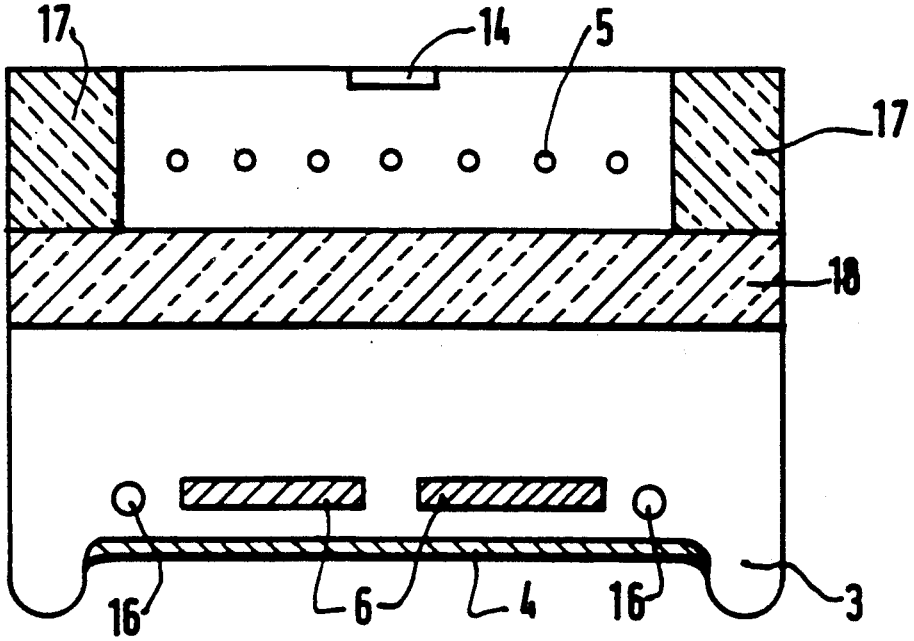
FIG. 4 is a cross-section of a removable hotplate according to the invention.

In order to simplify manufacture and to increase the efficiency of this transducer, the latter is plane and parallel to the base (4), as can be seen in FIG. 4. It is situated immediately above said base (4) and is at a maximum distance of 10 mm from the glass-ceramic plate (23) of the inductive heating-power source (9). A minimum distance of 4 mm, however, separates said base (4) from the glass-ceramic plate so as to enable the heat generated in the casing (1) by the resistor (5) to dissipate. This distance is advantageously close to 7 mm.

In an improved embodiment, the secondary circuit (19) is closed by means of a switch (22) actuated by a thermostat, in particular an electromagnetic thermostat (13), the latter opening or closing the circuit depending on the temperature measured by a probe (14) situated on the inner surface of the hotplate (2).

In addition, an auxiliary loop (16), provided around the transducer (6) and situated in the same plane as the latter, enables an indicator lamp (15), in particular an electroluminescent diode, to be supplied. Consequently, when the resistor (5) is supplied with power, the indicator (15) lights up, telling the user that the unit is operating satisfactorily.

According to a basic feature of the invention, the inductance L of the transducer (6), as well as the capacitance C of the capacitor (12) are fixed such that the secondary oscillating circuit thus formed has a natural resonant frequency slightly higher than the operating frequency of the generator (10) of the inductive heating-power source (9). Indeed, as is known, the natural resonant frequency $f_o$ of such a trap circuit is given by the equation:

$$4\pi^2 \cdot L \cdot C f_o^2 = l$$

The power released at the resistor (5) is consequently close to the nominal power of the generator. Moreover, in order to absorb the greatest possible power, the transducer (6) has a greater number of turns than the inductor (8).

Taking into account the values given by design for the self-induction coil forming the transducer (6), for the capacitor (12) and for the resistor (5), and on the other hand taking into account the total distance separating the inductor (8) from the transducer (6), which by design never exceeds 20 mm, the hotplate thus formed enables the nominal power of the underlying inductive heating-power source to be absorbed.

The electric heating unit is advantageously split into two parts, a hot part having the general reference (20) and a cold part (21), respectively. The hot part basically comprises the hotplate proper (2) under which the resistor (5) and the transducer (6) are situated. Similarly, as already mentioned, the hotplate (2) has on its inner surface the thermometric probe connected to the thermostat (13). In another embodiment according to the invention, the thermometric probe (14) is by design embedded in the bulk of the hotplate (2). The cold part, which is integral or not integral with the hot part, mainly comprises the capacitor (12), the thermostat (13) and optionally the lamp indicating satisfactory operation (15). The indicator lamp (15) as well as the thermostat (13) are situated on an accessible surface of the cold part (21) so as to enable the user to set the desired temperature and to see that the hotplate is working satisfactorily.

The two parts, hot (20) and cold (21), respectively, are interconnected by means of any element (24) appropriate for enabling the connections of the secondary circuit (19), and of the auxiliary loop of the indicator lamp, to pass through. This arrangement enables, on the one hand, the temperature-sensitive components, and in particular the capacitor, the box of the thermostat, and the indicator lamp, to be prevented from heating up excessively and, on the other hand, it makes the unit easy to handle as the cold part (21) may serve as a handle for the unit such that the plate may be carried even when hot as far as a sink so as to clean it, and optionally hang it up.

The two hot and cold parts, (20) and (21) respectively, may form just a single piece obtained, for example, by molding a molten metal and be made in particular from an aluminum alloy. The base (4) of the heating part (20) is, as already mentioned, attached after molding.

The heating resistor (5), situated in the hot part (20) of the unit parallel to and a few millimeters away from the hotplate proper (2), is thermally insulated from the remainder of the various components listed hereinabove. Only the part opposite the hotplate (2) is not thermally insulated. This insulation is realized by means of mineral-based microporous thermal insulating materials (17, 18) enabling efficient insulation for high temperatures. In addition, and advantageously, the inner surface of the hotplate (2) undergoes a surface treatment enabling the infra-red radiation produced by the resistor (5) to be absorbed and enabling in particular the heat released at the hotplate to be increased.

In an alternative embodiment of the invention, however, the resistor (5) is embedded in the bulk of the hotplate (2) in order to obtain a heating mat.

Said hotplate (2) may thus be used as a cooking plate, in particular for grills or pizza, the food being placed directly on this plate which is coated with a layer of food-grade material, or even with a material to which food does not stick. Similarly, the hotplate (2) may be used as a so-called "hot buffet" plate, in other words as an actual hotplate which can keep a dish or a saucepan, and in particular its contents, at a desired temperature.

It should be noted that, in the latter case, the hotplate may have a size of up to a square meter, whilst still having a simple inductive heating-power source as long as the temperature required does not exceed 70° C. since, as already mentioned, the shape of the resistor (5) used may be modified to the precise needs of the user. It should be noted that it becomes possible to use induction with ordinary non-magnetic saucepans.

In a different embodiment of the invention, the electromechanical thermostat is replaced by an electronic thermostat. Similarly, certain additional electronic functions such as a clock, a programmer, a digital thermometer or even a set of signal lights for each useful temperature level, etc. may be added. Advantageously, another auxiliary loop (not shown), situated around the self-induction coil of the transducer (6) is added to the secondary electric circuit and supplies a rechargeable battery, for example a cadmium-nickel battery which is situated in the cold part (21) and intended to supply power to these various electronic components when the unit is no longer supplied via the inductive heating-power source.

The electric hotplate according to the present invention consequently has advantages which were unobtainable hitherto with the known devices. The following may be mentioned:

the hotplate formed in this way is light (2 to 5 kg) and has a reduced size, making it easy and very safe to handle, in particular so that it can be washed, and is hence more hygienic. It is made even more easy to handle by there being no mains lead and by the fact that the whole plate is waterproof;

since the thickness of the casing is relatively small, there is a limited temperature delay which thus enables the plate to heat up quickly; moreover, taking into account the good thermal conductivity of the plate, the heating up is uniform over its entire surface area; this uniformity is improved by an appropriate distribution of the surface of the resistor;

the desired temperature is permanently controlled by the thermostat, allowing the food to be cooked as the user wishes;

a high degree of accuracy in terms of the cooking temperature, in view on the one hand of the small mass of the unit relative to the total available power and on the other hand of the virtually in situ temperature measurement;

because of the structure and the components of the secondary circuit, the maximum nominal power of the inductive heating-power source may be used, thus making such equipment more economical.

We claim:

1. A portable inductively heated electric hotplate and an inductive heating power source comprising, in combination, a power source primary induction coil member connected to a source of AC electric power, a glass ceramic plate mounted adjacent said primary induction coil to form a surface on the power source for receiving thereon a portable electric hotplate;

a portable electric hotplate having an outer heat conductive hotplate casing;

a casing top member forming a heating surface;

a base member made of an electrically insulating material;

at least one electrical resistor mounted adjacent said top casing member connected to a secondary electric circuit formed within said portable hotplate, said secondary electric circuit having a secondary induction coil member mounted adjacent said base member, connected in parallel with a capacitor;

said primary and secondary induction coil members being adapted to form a magnetic circuit for transfer of electromagnetic energy when said portable hotplate is positioned on said power source glass ceramic plate; and the values for the inductance of the secondary-inductance coil and for the capacitance of the capacitor in the secondary circuit being selected such that the oscillating circuit thus defined in the secondary circuit has a resonant frequency higher than that of the primary induction circuit of the heating power source.

2. The portable electric hotplate according to claim 1 further including a thermostatically actuated switch connected in the secondary circuit between the induction coil and the resistor and a temperature sensing element for controlling the thermostatic switch mounted on the inner surface of the hotplate top casing member.

3. The portable electric hotplate according to claim 2 wherein said portable, inductively heated hotplate portion comprises a hot portion including the heating resistor, the temperature sensing element, the hotplate casing and top member and the secondary induction coil; a cold portion, including the secondary capacitor, and the thermostatically actuated switch member; and electrical conductor means connecting said hot and cold portions.

4. The portable electric hotplate as claimed in claim 1 further including a thermostatically operated switch connected in the secondary circuit between the induction coil and the resistor and a thermostat actuating member, embedded in the hotplate top member, connected to said switch.

5. The portable electric hotplate according to claim 1 wherein the secondary induction coil member is spaced from the glass ceramic plate a distance of between 2 and 20 millimeters when said portable hotplate is positioned on the glass ceramic plate of said heating power source.

6. The portable electric hotplate according to claim 1 wherein said heating resistor is thermally insulated on all surfaces except the surface opposite the hotplate top member.

7. The portable electric hotplate according to claim 6 wherein said heating resistor is thermally insulated with a mineral base microporous thermoinsulating material.

8. The portable electric hotplate according to claim 1 further including an indicator lamp and second induction coil means mounted adjacent the bottom of said portable electric hotplate, both electrically connected together so as to indicate application of power to said resistor when said lamp is illuminated.

* * * * *